US009739588B1

(12) United States Patent
Marken

(10) Patent No.: US 9,739,588 B1
(45) Date of Patent: Aug. 22, 2017

(54) BOOK ALIGNMENT DEVICE AND METHOD

(71) Applicant: Frederick R. Marken, Hornbrook, CA (US)

(72) Inventor: Frederick R. Marken, Hornbrook, CA (US)

( * ) Notice: Subject to any disclaimer, the term of this patent is extended or adjusted under 35 U.S.C. 154(b) by 174 days.

(21) Appl. No.: 14/944,852

(22) Filed: Nov. 18, 2015

Related U.S. Application Data

(60) Provisional application No. 62/083,828, filed on Nov. 24, 2014.

(51) Int. Cl.
*G01B 5/25* (2006.01)

(52) U.S. Cl.
CPC ..... *G01B 5/25* (2013.01)

(58) Field of Classification Search
CPC ..... G01B 5/25
USPC ..... 33/533, 613, 645
See application file for complete search history.

(56) References Cited

U.S. PATENT DOCUMENTS 1,460,348 A * 6/1923 Nelson ..... G01B 5/00 33/501
2,585,421 A * 2/1952 Armand ..... B42D 9/008 116/235
2,684,765 A 7/1954 Lowenstein
2,945,599 A 7/1960 Simpson
3,169,320 A * 2/1965 Currie ..... E04G 21/1891 33/429
4,719,704 A * 1/1988 Hogg ..... G01B 5/207 33/288
4,958,814 A * 9/1990 Johnson ..... E04G 21/1891 248/216.1
5,402,320 A 3/1995 Kielstra et al.
5,740,926 A 4/1998 Mulloy
6,070,336 A * 6/2000 Rodgers ..... E04G 21/1891 33/370
6,421,928 B1 * 7/2002 Miller ..... A47G 1/205 33/520
6,895,684 B1 * 5/2005 Firth ..... E04G 21/1891 33/562
7,617,612 B2 * 11/2009 Brizendine ..... E04D 15/00 33/613
7,739,820 B2 6/2010 Frank
9,670,675 B2 * 6/2017 Doyle ..... E04C 2/34
2006/0010703 A1 * 1/2006 Gauthier ..... E04G 21/1891 33/613
2010/0186244 A1 * 7/2010 Schwindt ..... B60R 11/04 33/288

(Continued)

*Primary Examiner* — G. Bradley Bennett
(74) *Attorney, Agent, or Firm* — Jerry Haynes Law

(57) ABSTRACT

A book alignment device engages a back side of objects that are misaligned on a plane and applies a transverse force against the back side of the objects to align the objects on the plane. The device aligns the separate, misaligned objects into a single aligned set of objects. In this manner, the objects are not only aligned, but compacted into a stronger, unitary configuration that forms a single set of objects. An alignment rod forms an elongated member having a substantially straight configuration and a pair of free ends. The alignment rod engages a back side of the objects to pull them forward into alignment. A pair of lateral bars extend from the free ends of the alignment rod. The lateral bars have a distal end that perpendicularly joins the free ends of the alignment rod, and a proximal end that enables manipulation of the alignment rod.

20 Claims, 5 Drawing Sheets

(56) References Cited

U.S. PATENT DOCUMENTS

| | | | | |
|---|---|---|---|---|
| 2013/0145635 | A1* | 6/2013 | Dallman | B43L 3/00 33/286 |
| 2014/0182154 | A1* | 7/2014 | Tommy | E04F 21/0007 33/533 |
| 2014/0283403 | A1* | 9/2014 | Frazer | B25H 7/04 33/670 |
| 2015/0096185 | A1* | 4/2015 | Doyle | E04F 21/003 33/645 |

* cited by examiner

BOOK ALIGNMENT DEVICE AND METHOD

CROSS-REFERENCE TO RELATED APPLICATIONS

This application claims the benefits of U.S. provisional application No. 62/083,828, filed Nov. 24, 2014 and entitled ALIGNMENT TOOL, which provisional application is incorporated by reference herein in its entirety.

FIELD OF THE INVENTION

The present invention relates generally to a book alignment device and method. More so, the present invention relates to a book alignment device and method that enables engagement with a plurality of objects on a plane, such as misaligned books on a bookshelf, and application of a transversal force against a back side of the books to help align the books on the plane.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that bookshelves and bookcases are vertically arranged panels where books and other data are inserted and stored at multi-staged space thereof. Since most books are of similar sizes in height and depth, and are dimensioned to be substantially self-supporting, bookshelves have become quite standardized.

In many instances, books are often misaligned as they are constantly removed from the bookshelf to be read and then casually returned to their respective spots on the bookshelf. Generally, patrons of a library or any bookshelf do not take the time to properly align the books upon returning them. Also, reaching behind the books into the bookshelf can be difficult, especially for users with short arms or if the bookshelf is at a greater height.

There is another problem in that plural numbers of shelves are arranged in rows to have a plurality of books inserted thereinto, such that, unless there are special lighting systems to light the books, books or data cannot be properly distinguished or found because books are shaded by adjacent bookshelves.

Other proposals have involved aligning books or data on bookshelves. The problem with these gripping devices is that they do not allow for easy access behind the books to achieve optimal alignment. Even though the above cited alignment systems and methods meets some of the needs of the market, a book alignment device that has sufficient extension to engage a back side of books that are misaligned on a bookshelf and apply a transverse force against the back side of the books to align them on the bookshelf into a uniform row is still desired.

SUMMARY

Illustrative embodiments of the disclosure are generally directed to a book alignment device and method. The book alignment device, hereafter "device", serves to engage a back side of objects that are misaligned on a plane and applies a transversal force against the back side of the objects to align the objects on the plane in to a uniform row. In one embodiment, the objects are books, and the plane is a bookshelf. The device aligns the separate, misaligned objects into a single aligned set of objects. In this manner, the objects are not only aligned, but compacted into a stronger, unitary configuration that forms a single set of objects.

In one embodiment, an alignment rod forms an elongated member having a longitudinal axis with a substantially straight configuration. The alignment rod also includes a pair of free ends. The alignment rod is configured to engage a back side of the objects, so as to pull the objects forward towards a user, and into alignment with the other objects in a row. The back side of the objects may include the side of the objects that is not visible. The alignment rod is configured to enable facilitated engagement to the backside of the objects. In one embodiment, the backside may include a distal region of a bookshelf.

A pair of lateral bars extend from the free ends of the alignment rod. The lateral bars have a distal end that perpendicularly joins with the free ends of the alignment rod. The lateral bars further have a proximal end that enables manipulation of the alignment rod. The proximal end may include a depression to provide a grip for enhanced manipulation of the device. In one alternative embodiment, a central rod extends from a median point on the alignment rod to enable manipulation of the alignment rod.

One aspect of the alignment device for at least partially aligning a plurality of objects along a plane, comprises:

- an alignment rod defined by a longitudinal axis and a pair of free ends, the alignment rod configured to enable application of a transverse force across a plane,
- whereby the alignment rod is configured to be substantially parallel with the plane when applying the transverse force; and
- a pair of lateral bars, the pair of lateral bars defined by a distal end and a proximal end, the distal end configured to join with the pair of free ends of the alignment rod in a substantially perpendicular arrangement, the proximal end comprising a depression, the depression configured to form a grip for enabling manipulation of the alignment rod,
- whereby the pair of lateral bars are configured to enable manipulation of the alignment rod for applying the transverse force to the alignment rod.

In another aspect, the plurality of objects are books.

In another aspect, the plane is a bookshelf that supports the books.

In another aspect, the alignment device is configured to align a backside of the books on the bookshelf.

In another aspect, the back side of the objects is the section of the books along the distal region of the bookshelf not readily visible and difficult to access.

In another aspect, the alignment rod is cylindrical.

In another aspect, the alignment rod is flat.

In another aspect, the transverse force is a horizontal pulling force.

In another aspect, the distal end of the pair of lateral bars fastens to the free ends of the alignment rod.

In another aspect, the pair of lateral bars are at least 24 inches long.

In another aspect, the distal end of the pair of lateral bars comprises a bore hole, whereby the bore hole is configured to enable coupling with the free ends of the alignment rod.

One objective of the present invention is to provide a device that facilitates alignment of books on a long bookshelf.

Another objective is to provide a straight alignment rod that easily engages a backside of the books.

Another objective is to provide a pair of lateral bars that enable applying a small pulling force against the back side of the books to move them as a single set into alignment.

Another objective is to manufacture an alignment device that is inexpensive to build and easy to use.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
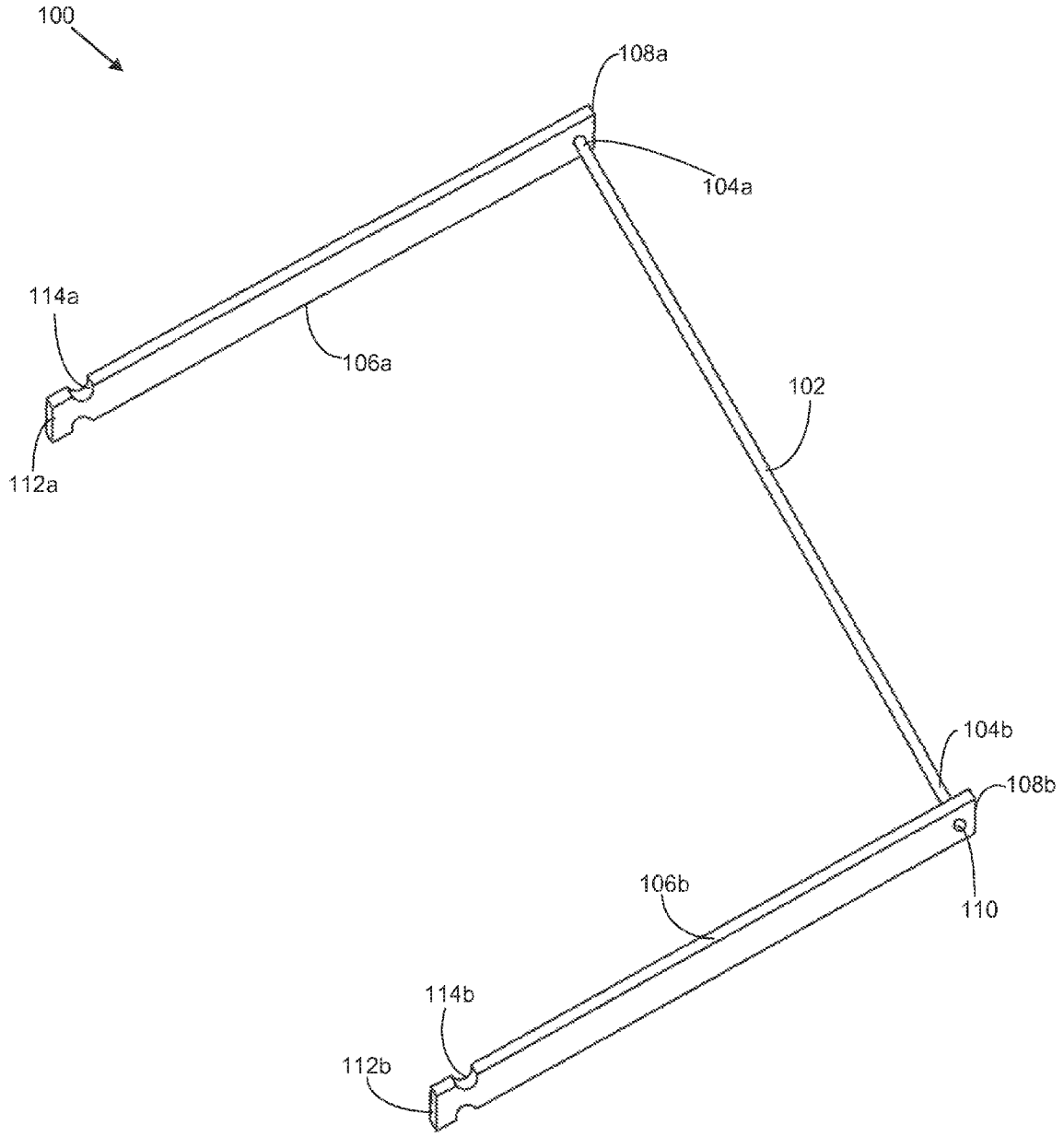
FIG. 1 illustrates an isometric view of an exemplary book alignment device having a cylindrical alignment rod, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A book alignment device 100 and method 200 is described in FIGS. 1-7. In some embodiments, the book alignment device 100 may help to align a plurality of objects (not shown) that are misaligned on a plane, and apply a transverse force across the plane and against a back side of the objects. In this manner, the objects may easily be aligned into a uniform row. The unique configuration of the book alignment device 100, hereafter "device 100" works to align the separate, misaligned objects into a single aligned set of objects. Thus, once aligned, the objects still remain individual and separable, but the device 100 compacts the objects into a single, uniform set of aligned objects. In this manner, the objects are not only aligned, but compacted into a stronger, unitary configuration that in many instances, may function as a single set of objects.

In one embodiment, the objects include a plurality of books on a bookshelf. The back side of the books, which may include either the binding or the front, openable edge of the books, is not readily visible and thus require the extendable reach of the device 100. Those skilled in the art will recognize that the books are often misaligned as they are constantly removed from the bookshelf to be read and then casually returned to their respective spots on the bookshelf. Generally, patrons of a library or any bookshelf do not take the time to properly align the books upon returning them. Also, reaching behind the books into the bookshelf can be difficult, especially for users with short arms or if the bookshelf is at a greater height.

As referenced in FIG. 1, the device 100 may include an alignment rod 102. The alignment rod 102 forms an elongated member having a longitudinal axis with a substantially straight configuration. The alignment rod 102 terminates at a pair of free ends 104*a-b*. The longitudinal axis of the alignment rod 102 engages a back side of the objects to pull them forward into alignment. The back side is the side of the objects that is not apparently visible, such as the distal side of the objects. In one embodiment, the backside may include a distal region of a bookshelf. The alignment rod 102 is manipulated to enable facilitated engagement to the backside of the objects for alignment of the objects.

In some embodiments, the alignment rod 102 is configured to apply a transverse force across a plane. The plane may include a bookshelf that supports a row of the objects. The transverse force may include a pulling force that is greater to resistance created from the weight of the objects and the friction generated between the objects and the plane. In some embodiments, the alignment rod 102 is substantially parallel with the plane when applying the transverse force across the plane. In this manner, the alignment rod 102 is oriented to engage the greatest number of objects from the back side.

Figure 2:
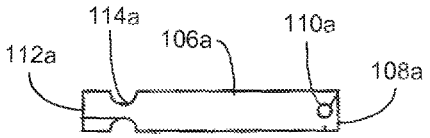
FIG. 2 illustrates an elevated side view of a book alignment device, in accordance with an embodiment of the present invention.

Turning now to FIG. 2, the longitudinal axis of the alignment rod 102 engages the back side of a substantial portion of the objects, so as to provide the larger surface area for applying the transverse force on the objects. This larger area of engagement offered by the alignment rod 102 facilitates alignment of the individual objects into alignment as a single, flush set of objects. The longitudinal axis of the alignment rod 102 is configured to remain engaged with the back side of the objects while applying the transverse force. This orientation allows the longitudinal axis to remain flush against the back side of the objects during initial engagement, movement, and disengagement. The alignment rod may then move transverse to the plane, pulling the objects forward, and into alignment.

Figure 3:
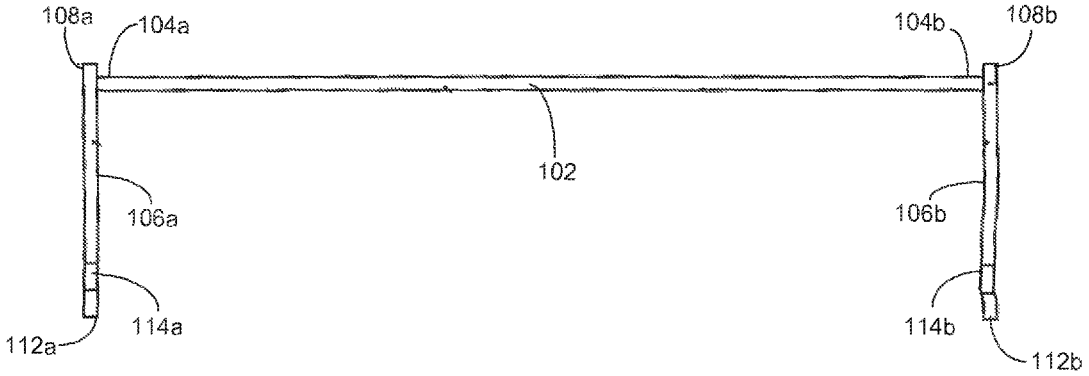
FIG. 3 illustrates a plan view of a book alignment device, in accordance with an embodiment of the present invention.
Figure 4:
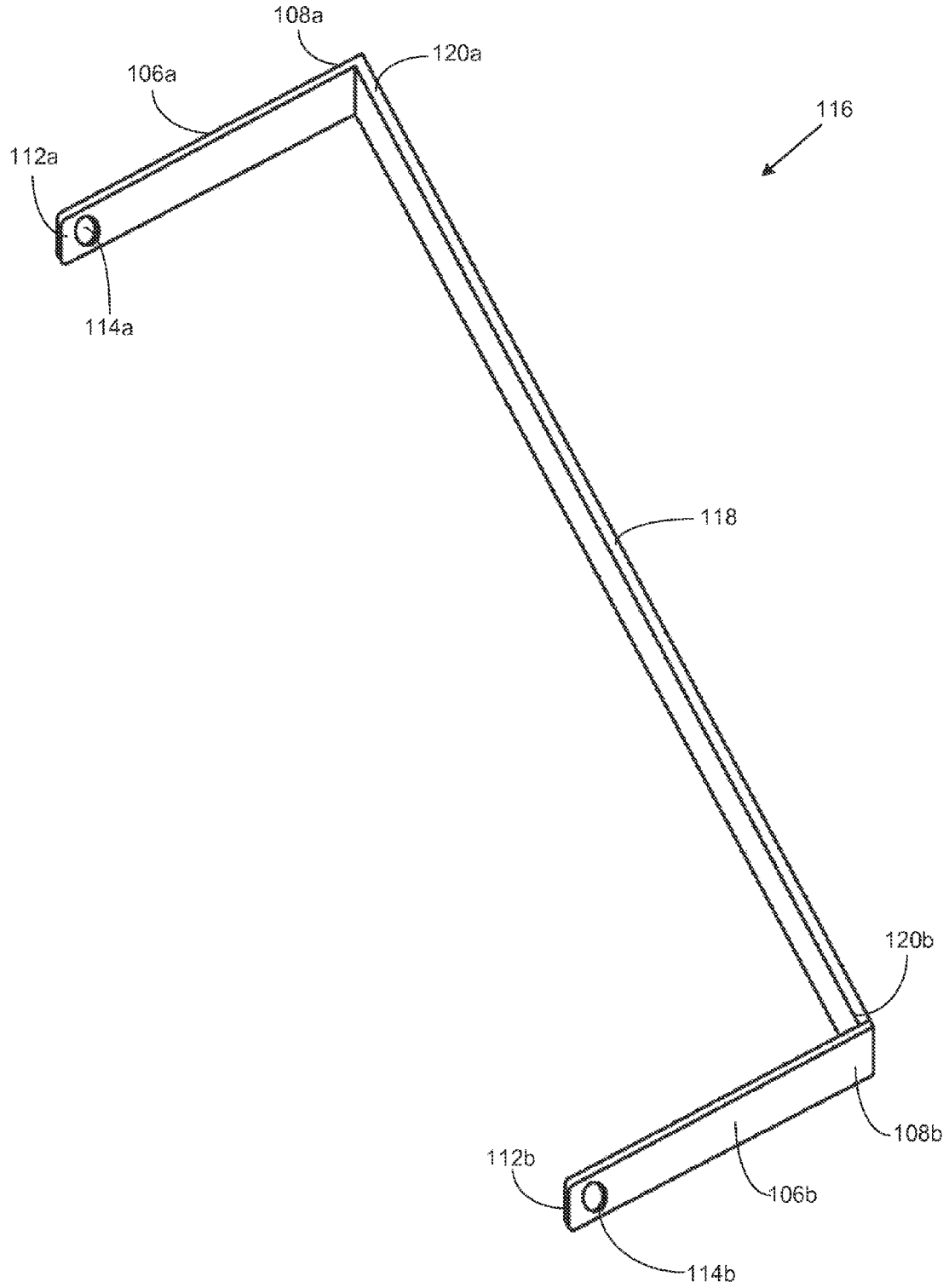
FIG. 4 illustrates an isometric view of an exemplary second embodiment of a book alignment device having a flat alignment rod, in accordance with an embodiment of the present invention.

One example of an alignment rod 102, shown in FIG. 3, may include a ½" diameter hardwood dowel that is generally cylindrical in shape and about 34" long. Referring to FIG. 4, however, a second embodiment of a book alignment device 116 comprises an alignment rod 118 that forms a ½" wide strip of hardwood. Though, both the first embodiment of the device 100, and the second embodiment of the device 116 work in substantially the same manner. In yet another alternative embodiment, the alignment rod 102 is configured to telescopically extend and retract in length. Suitable materials for the alignment rod 102 may include, without limitation, metal, wood, and a rigid polymer.

In some embodiments, a pair of lateral bars 106*a-b* extend from the free ends 104*a-b* of the alignment rod 102. Each lateral bar 106*a-b* is defined by a distal end 108*a-b* that joins with the free ends 104*a-b* of the alignment rod 102. The distal end 108*a-bs* of the lateral bars 106*a-b* fixedly engage the alignment rod 102 in a substantially perpendicular disposition. In one embodiment, the distal end 108*a-b* comprises a bore hole 110, through which the alignment rod 102 passes (FIG. 2).

Figure 5:
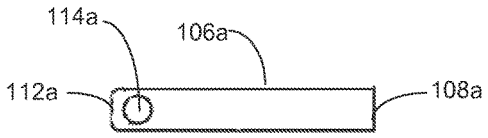
FIG. 5 illustrates an isometric view of a second embodiment of a book alignment device, in accordance with an embodiment of the present invention.
Figure 6:
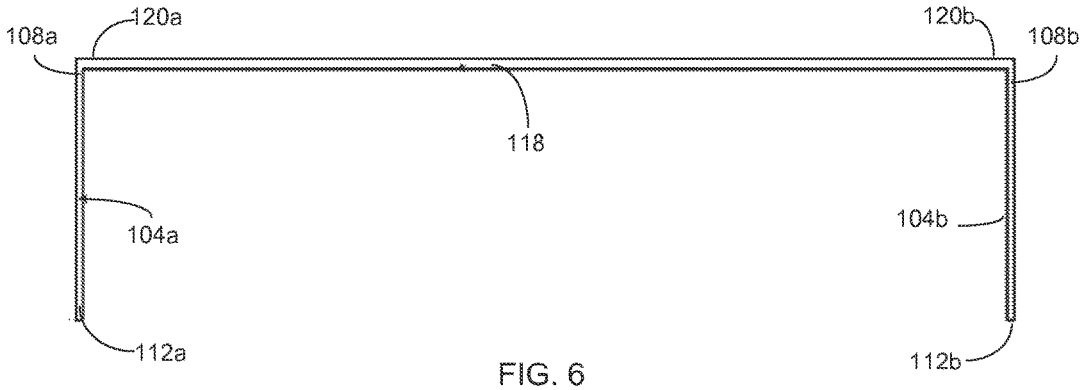
FIG. 6 illustrates an isometric view of a second embodiment of a book alignment device, in accordance with an embodiment of the present invention.

In another embodiment, a fastener, such as an adhesive or screw joins the free ends 104*a-b* of the alignment rod 102 to the distal end 108*a-b* from the lateral bars 106*a-b*. Turning now to FIGS. 5 and 6, in the second embodiment of the book alignment device 116, the second embodiment alignment rod 118 has, however, a second embodiment pair of free ends 120*a-b* that are substantially flat and fasten to the lateral bars 106*a-b* through welding, adhesives, or frictional fitting.

Each lateral bar 106*a-b* further includes a proximal end 112*a-b* that enables manipulation of the alignment rod 102. The proximal end 112*a-b* may include a depression 114*a-b* to provide a grip for enhanced manipulation of the device 100. The depression 114*a-b* is configured to enable manipulation of the alignment rod 102 substantially parallel with the plane, and for applying the transverse force to the alignment rod 102. The depression 114*a-b* can also be used to lift and lower the lateral bars 106*a-b* between the objects for engaging the alignment rod 102 with the back side of the objects.

The lateral bars 106*a-b* serve to position the alignment rod 102 in a substantially flush position to the alignment rod 102 against the back side of the objects to bring the objects into alignment. Thus, the width of the lateral bars 106*a-b* must be at least as long as the width of the objects so as to extend the alignment rod 102 into position on the back side of the objects. The lateral bars 106*a-b* must also be sufficiently rigid so as to apply transverse and lateral forces on the objects during alignment. In one embodiment, the pair of lateral bars 106*a-b* are 9½" long plastic bars. Suitable materials for the lateral bars 106*a-b* may include, without limitation, metal, wood, and a rigid polymer.

It is significant to note that if the alignment rod 102 is not long enough to engage all of the objects, either lateral bars 106*a-b* may be removed from the intersection between the two objects and forced to intersect at another section of two objects along the plane. It is also significant to note that if the objects are not uniform in size and dimension, the alignment rod 102, which is generally linear, may not fully engage the back side to align all of the objects. In one embodiment, the objects include a plurality of books on a shelf, which serves as the plane.

In one alternative embodiment, a central rod (not shown) extends from a median point on the alignment rod 102 to enable manipulation of the alignment rod 102. The central rod is defined by a mount end and a control end. The central rod may have a generally linear, elongated shape. In some embodiments, the control end may include a handle that provides a grip to manipulate the central rod, and thereby the alignment rod 102. The mount end of the central rod intersects the alignment rod 102 in a substantially perpendicular disposition.

In one embodiment, the mount end of the central rod passes through the alignment rod 102 and threadably fastens to a central area of the alignment rod 102 with at least one fastener. The at least one fastener may include a washer and a nut. In other embodiments, the fastener may, however, include, without limitation, a weld, a magnets, a screw, a cord, a wires, and an adhesive.

Similar to the pair of lateral bars 106*a-b*, the central rod serves to position the alignment rod 102 in a substantially flush position against the back side of the objects. The central rod also applies the transverse force along the back side of the objects to bring the objects into alignment. Thus, the length of the central rod must be at least as long as the width of the objects so as to extend the alignment rod 102 into position on the back side of the objects. The central rod must also be sufficiently rigid so as to intersect and forcefully pass through a space between two of the objects.

In one possible embodiment, the central rod is configured to intersect through any space between the individual objects. The intersection may require various amounts of force to create separation between two objects. The amount of force is dependent on the weight of the objects and the size of the space between the objects. In some embodiments, the central rod may intersect a space in a central section of the objects. In this manner, the attached alignment rod 102 positions against the maximum possible number of individual objects.

Figure 7:
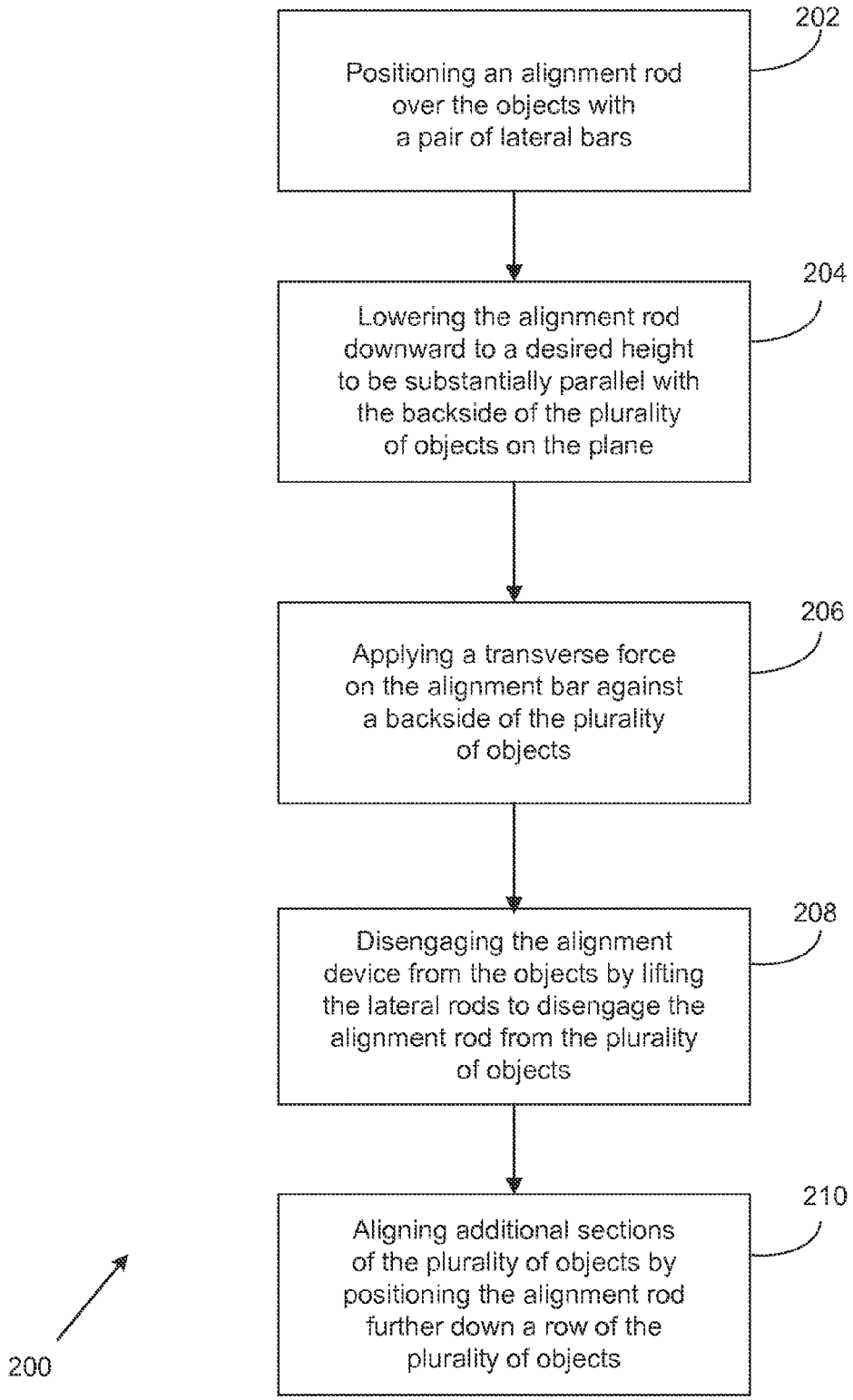
FIG. 7 illustrates a flowchart diagram of an exemplary method for aligning objects on a plane with a book alignment device, in accordance with an embodiment of the present invention.

Looking at the flowchart of FIG. 7, a method 200 for aligning objects on a plane with a book alignment device 100 comprises an initial Step 202 of positioning the alignment rod 102 over the objects with a pair of lateral bars 106*a-b*. The lateral bars 106*a-b* serve to position the alignment rod 102 in a substantially flush position to the alignment rod 102 against the back side of the objects to bring the objects into alignment. A Step 204 comprises lowering the alignment rod 102 downward to a desired height to be substantially parallel with the backside of the objects on the plane. The length of the lateral bars 106*a-b* provides sufficient extension to enable reaching behind the objects.

The method 200 further includes a Step 206 of applying a transverse force on the alignment bar against a backside of the plurality of objects. This may be accomplished by pulling the lateral bars 106*a-b* forwards, towards a user to create the transverse force by the alignment rod 102 against the back side of the objects. The transversal force, parallel with the plane creates the chief impetus for aligning the objects. The method 200 may further include a Step 208 of disengaging the alignment device from the objects by lifting up the lateral bars 106*a-b* to disengage the alignment rod from the objects. A final Step 210 includes aligning additional sections of the row of objects by positioning the alignment rod 102 further down the row. In this manner, a row of objects having a substantial length may be aligned sequentially, section by section.

In one alternative embodiment, the alignment device 100 is configured to align eclectic objects, including, without limitation, boxes, food products, electronics, games, chairs, tables, bacterium in a petri dish, and containers on a cargo ship, train, or semi-truck. In another alternative embodiment, the alignment device 100 may be sized to microscopic sizes or formed into a large crane size for moving cargo containers on a truck or ship. The same principles of inserting an alignment rod 102 between objects and applying a transverse force across the plane that supports the objects, however, generally applies to all types of objects.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An alignment device for at least partially aligning a plurality of objects along a plane, the alignment device comprising:

an alignment rod defined by a longitudinal axis and a pair of free ends, the alignment rod configured to enable application of a transverse force across a plane, whereby the alignment rod is configured to be substantially parallel with the plane when applying the transverse force; and a pair of lateral bars, the pair of lateral bars defined by a distal end and a proximal end, the distal end configured to join with the pair of free ends of the alignment rod in a substantially perpendicular arrangement, the proximal end comprising a depression, the depression configured to form a grip for enabling manipulation of the alignment rod, whereby the pair of lateral bars are configured to enable manipulation of the alignment rod for applying the transverse force to the alignment rod.

2. The device of claim 1, wherein the alignment rod is a ½ inch diameter hardwood dowel.

3. The device of claim 1, wherein the alignment rod is configured to telescopically extend and retract in length.

4. The device of claim 1, wherein the alignment rod is at least 36 inches long.

5. The device of claim 1, wherein the distal end of the pair of lateral bars comprises a bore hole, the bore hole configured to enable coupling with the free ends of the alignment rod.

6. The device of claim 1, further including at least one fastener, the at least one fastener configured to fasten the distal end of the pair of lateral bars to the free ends of the alignment rod.

7. The device of claim 1, further including a central rod.

8. The device of claim 7, wherein the central rod is defined by a mount end and a control end, the mount end disposed to join with the alignment rod in a substantially perpendicular arrangement, the control end configured to enable manipulation of the alignment rod substantially parallel with the plane for applying the transverse force to the alignment rod.

9. The device of claim 8, wherein the mount end of the central bar fastens to a middle section of the alignment rod.

10. The device of claim 1, wherein the plurality of objects are a plurality of books.

11. The device of claim 10, wherein the plane comprises a bookshelf that supports the plurality of books in a row.

12. The device of claim 11, wherein the alignment device is configured to align a backside of the plurality of books on the bookshelf.

13. An alignment device for at least partially aligning a plurality of objects along a plane, the alignment device comprising:

an alignment rod defined by a longitudinal axis and a pair of free ends, the alignment rod configured to enable application of a transverse force across a plane, whereby the alignment rod is configured to be substantially parallel with the plane when applying the transverse force;

a pair of lateral bars, the pair of lateral bars defined by a distal end and a proximal end, the distal end configured to join with the pair of free ends of the alignment rod in a substantially perpendicular arrangement, the distal end of the pair of lateral bars comprising a bore hole, the bore hole configured to enable coupling with the free ends of the alignment rod, the proximal end comprising a depression, the depression configured to form a grip for enabling manipulation of the alignment rod, whereby the pair of lateral bars are configured to enable manipulation of the alignment rod for applying the transverse force to the alignment rod; and a central rod, the central rod defined by a mount end and a control end, the mount end disposed to join with the alignment rod in a substantially perpendicular arrangement, the control end configured to enable manipulation of the alignment rod substantially parallel with the plane for applying the transverse force to the alignment rod.

14. The device of claim 13, wherein the alignment rod is a ½ inch diameter hardwood dowel.

15. The device of claim 13, wherein the alignment rod is configured to telescopically extend and retract in length.

16. The device of claim 13, wherein the pair of lateral bars are at least 24 inches long.

17. The device of claim 13, wherein the mount end of the central bar fastens to a middle section of the alignment rod.

18. A method for aligning a plurality of objects on a plane with a book alignment device, the method comprising:

positioning an alignment rod over the objects with a pair of lateral bars;

lowering the alignment rod downward to a desired height to be substantially parallel with the backside of the plurality of objects on the plane;

applying a transverse force on the alignment bar against a backside of the plurality of objects;

disengaging the alignment device from the objects by lifting the lateral rods to disengage the alignment rod from the plurality of objects; and aligning additional sections of the plurality of objects by positioning the alignment rod further down a row of the plurality of objects.

19. The method of claim 18, wherein the alignment rod is configured to telescopically extend and retract in length.

20. The method of claim 18, wherein the alignment rod is a ½ inch diameter hardwood dowel.

* * * * *